US007202831B2

(12) United States Patent
Chen et al.

(10) Patent No.: US 7,202,831 B2
(45) Date of Patent: Apr. 10, 2007

(54) MULTI-BAND FREQUENCY LOOP-SLOT ANTENNA

(75) Inventors: Hong-Ren Chen, Chung Ho (TW); Kai Shih, Chung Ho (TW); Huang-Tse Peng, Chung Ho (TW); Yu-Yuan Wu, Chung Ho (TW)

(73) Assignee: Darts Technologies Corp., Taipei County (TW)

( * ) Notice: Subject to any disclaimer, the term of this patent is extended or adjusted under 35 U.S.C. 154(b) by 92 days.

(21) Appl. No.: 11/200,430

(22) Filed: Aug. 9, 2005

(65) Prior Publication Data

US 2007/0040745 A1 Feb. 22, 2007

(51) Int. Cl.
*H01Q 13/10* (2006.01)

(52) U.S. Cl. ..... 343/770; 343/767; 343/768; 343/700 MS

(58) Field of Classification Search ..... 343/770, 343/767, 700 MS
See application file for complete search history.

(56) References Cited

U.S. PATENT DOCUMENTS 7,102,575 B2 * 9/2006 Pan ..... 343/702
2003/0076268 A1 * 4/2003 Tarvas et al. ..... 343/702
2003/0112195 A1 * 6/2003 Cheng et al. ..... 343/767
2004/0155823 A1 * 8/2004 Kossiavas et al. ..... 343/702
2005/0237251 A1 * 10/2005 Boyle et al. ..... 343/770
2006/0290569 A1 * 12/2006 Boyle ..... 343/700 MS

* cited by examiner

*Primary Examiner*—Trinh Vo Dinh

(57) ABSTRACT

A loop-slot antenna defined by a conductive plate includes a first slot and a second slot. The first slot and the second slot divide the conductive plate into a first strip, a second strip and a patch element. The first slot is an L-shaped slot and includes a transverse slot section extending along the lower edge of the conductive plate and a longitudinal slot section extending along the left edge of the conductive plate and opening to the upper edge of the conductive plate. The first slot is operated at a first frequency. The first strip includes a transverse branch and a longitudinal branch that has a feed point. The second slot opens upward. The second strip has a free end on which a grounding point is disposed. The patch element is formed between the first and the second slots and operable at a second frequency.

10 Claims, 3 Drawing Sheets

MULTI-BAND FREQUENCY LOOP-SLOT ANTENNA

BACKGROUND OF THE INVENTION

1. Field of the Invention

The present invention relates generally to antennas, and more especially to multi-band frequency antennas including a slot antenna and a loop antenna.

2. The Related Art

Antennas are used in various communication systems, such as cellular phones, wireless data and local area network, global system for mobile communications (GSM), and personal communication service (PCS), etc. A clear and strong signal is critical for the wireless communication systems. Therefore, antennas with good performance are required.

As shown in FIG. 3, a conventional antenna 100 comprises a first element 70 and a second inverted-L element 80. The first element 70 and the second inverted-L element 80 are connected at a first portion and a second portion of the first element 70. A feed point 71 is disposed on the first portion and a grounding point 72 is disposed on the second portion.

When the conventional antenna 100 is working for communicating, the first element 70 resonates at a first frequency, and the second inverted-L element 80 resonates at a second frequency. However, while the second inverted-L element 80 is resonating, the first element 70 also resonates at a certain extend which affects the performance of the second inverted-L element 80. So when the second inverted-L element 80 receives/sends signals, the performances of radiation are not efficient so as to affect the performance of the antenna 100. In order to improve the performance of the antenna 100, tuner components (such as resistances, capacitors etc.) are applied. For example, a first tuner component 73 is coupled with the feed point 40, and a second tuner component 74 is coupled with the grounding point 50. Therefore, the performance of the antenna 100 is improved after the first and second tuner components 73, 74 being coupled with the antenna 100.

As described above, the conventional antenna 100 needs two extra tuner components 73, 74 to improve the performance. Thus, the structure of the antenna 100 is complicated with high cost, and the complicated structure of the antenna 100 is inconvenient for installation so as to affect the performance of the antenna 100.

SUMMARY OF THE INVENTION

An object of the present invention is to provide a loop-slot antenna having a simple structure for low cost and easy installation and being operable at multi-band frequency.

According to the present invention, the loop-slot antenna defined by a conductive plate comprises a first slot and a second slot. The first slot and the second slot divide the conductive plate into a first strip, a second strip and a patch element. The first slot has a transverse slot section extending along the lower edge of the conductive plate and a longitudinal slot section extending along the left edge of the conductive plate and opening to the upper edge of the conductive plate. The first strip includes a transverse branch located below the transverse slot section and a longitudinal branch located beside the longitudinal slot section. A feed point is disposed on the top end of the longitudinal branch. The second slot is defined in the conductive plate and extends along the upper edge of the conductive plate with the left end opening to the upper edge of the conductive plate. The second strip is located above the second slot and has a free end. A grounding point is disposed on the free end of the second strip. The patch element is located between the first and the second slots. The first slot is a slot antenna and operable at a first frequency. The patch element is a loop antenna and operable at a second frequency.

As mentioned above, the loop-slot antenna uses a combination of the first slot and a patch element to respectively resonate at the first frequency and the second frequency. Thus, the loop-slot antenna is operated at multi-band frequency. The structure of the loop-slot antenna is simple so that it can be integrally formed with low cost and convenient for installation in a mobile phone.

BRIEF DESCRIPTION OF THE DRAWINGS

The above-mentioned and other features and objects of this invention and the manner of attaining them will become more apparent and the invention itself will be better understood by reference to the following description of preferred embodiments of the invention taken in conjunction with the accompanying figures, wherein.

DETAILED DESCRIPTION OF THE PREFERRED EMBODIMENTS

The present invention provides an embedded loop-slot antenna with multi-band frequency radiation capability. The structure described in the present invention provides a compact, low-profile antenna that can be mounted internally in a mobile phone with performance comparable to external multi-band antennas.

Figure 1:
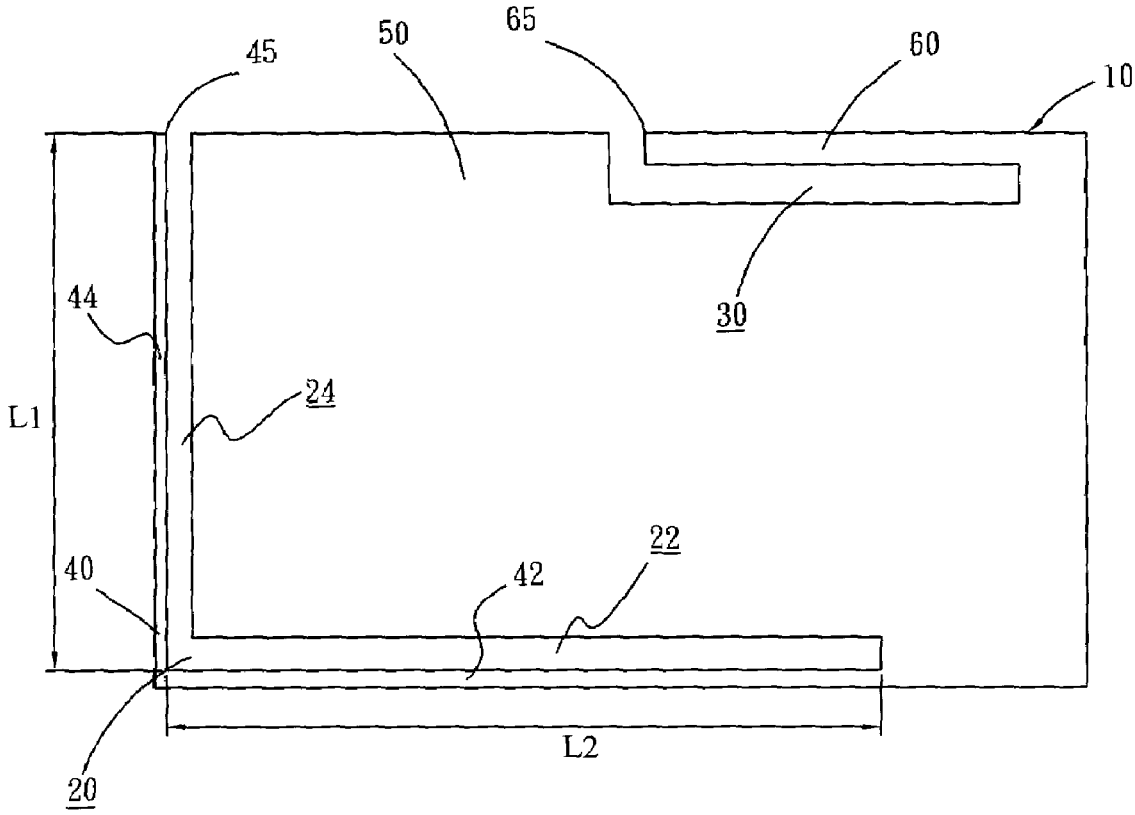
FIG. 1 is a front plan view of a loop-slot antenna of the present invention according to a first preferred embodiment.

With reference to FIG. 1, the loop-slot antenna is defined by a conductive plate 10 having a generally rectangular outer perimeter. According to the present invention, the conductive plate 10 is made of either metallic material or otherwise of flexible printed circuit board. The loop-slot antenna comprises a first slot 20 and a generally rectangular second slot 30. The first slot 20 and the second slot 30 divide the conductive plate into a first strip 40, a patch element 50 and a second strip 60.

The first slot 20 includes a transverse slot section 22 extending along the lower portion of the conductive plate 10 and a longitudinal slot section 24 extending upward along the left edge of the conductive plate 10 from the left end of the transverse slot section 22. The right end of the transverse slot section 20 is a closed-end. The left end of the transverse slot section 22 communicates with the longitudinal slot section 24. The longitudinal slot section 24 opens to the upper edge of the conductive plate 10. Thus, the first slot 20 is an L-shaped slot and is an open-end slot antenna. The first slot 20 resonates at the first frequency (high frequency band). The sum of the electrical length L1 of the transverse slot section 22 and the electrical length L2 of the longitudinal slot section 24 is about a quarter wavelength of the first frequency.

The first strip 40 includes a transverse branch 42 located below the transverse slot section 22 and a longitudinal branch 44 extending upward from the left end of the transverse branch 42 and located beside the longitudinal slot section 24. The first strip 40 is an L-shaped structure corresponding to the first slot 20. The top portion of the longitudinal branch 44 is a free end and aligned with the upper edge of the conductive plate 10. A feed point 45 is disposed on the free end of the longitudinal branch 44 and couples with a signal feed port of RF circuit of the mobile phone.

The second slot 30 is a transverse slot and extends along the upper edge of the conductive plate 10. The left end of the second slot 30 opens to the upper edge of the conductive plate 10.

The second strip 60 is located above the second slot 30. The left end of the second strip element 60 is a free end. A grounding point 65 is disposed on the free end of the second strip 60 and couples with a grounding port of RF circuit of the mobile phone.

The patch element 50 is located between the first slot 20 and the second slot 30. The patch element 50 is a loop antenna and operated at a second frequency (low frequency band).

The first slot is configured to be operated at the higher frequency bands including DCS (1800 MHz) and PCS (1900 MHz). The patch antenna 50 is configured to achieve radiation at the lower frequency band GSM 900 MHz. While the loop-slot antenna is operated for communicating, the patch element 50 resonates at the lower frequency band, and the electrical length from the feed point 45 through the patch antenna 50 to grounding point 65 is about a half wavelength of the lower frequency. Thus, the patch element 50 sends/receives signals of the lower frequency and achieves better performance.

Figure 2:
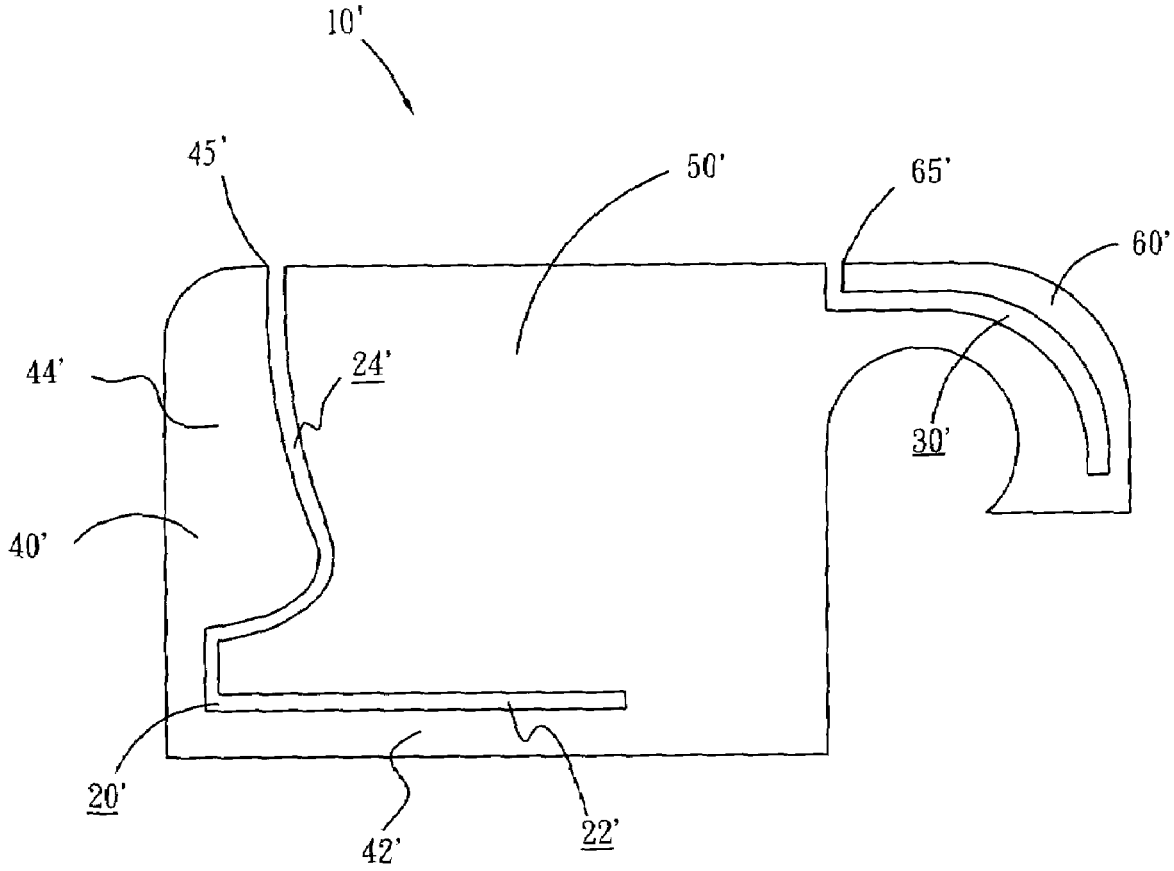
FIG. 2 is front plan view of the loop-slot antenna of the present invention according to an alternative preferred embodiment.
Figure 3:
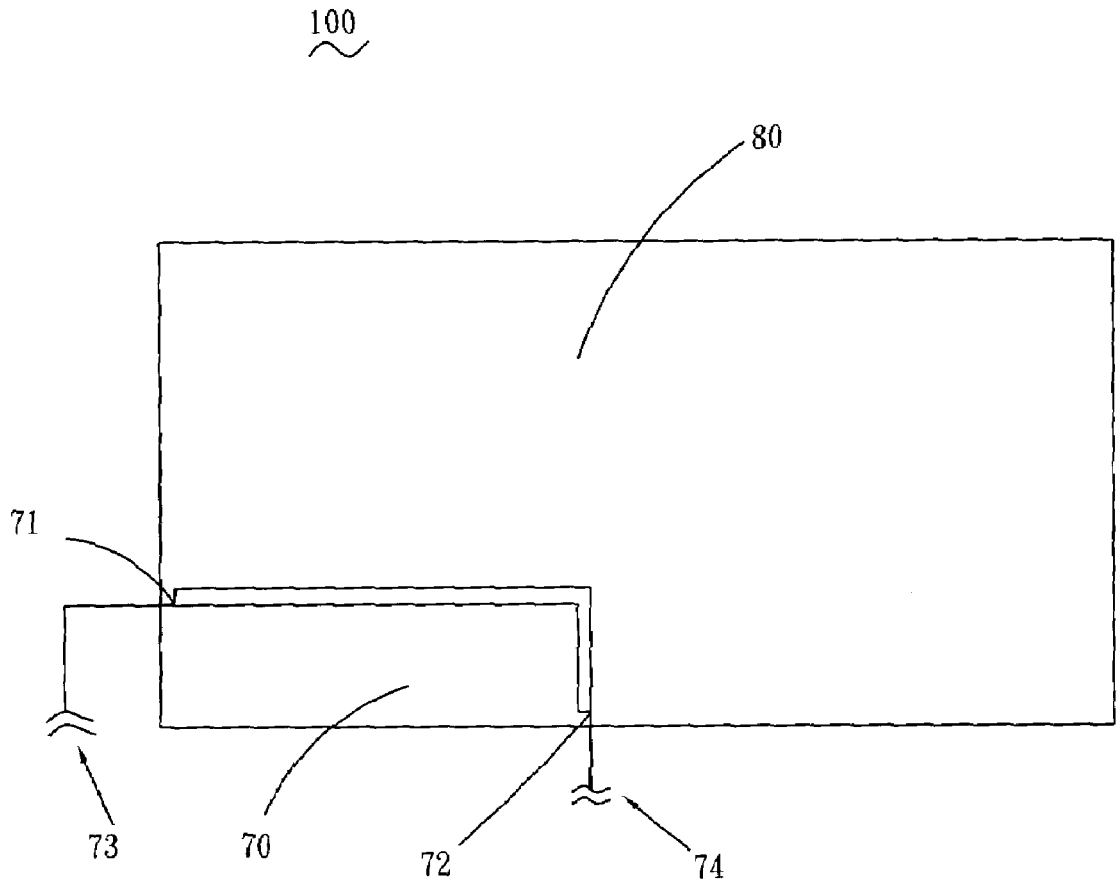
FIG. 3 PRIOR ART
FIG. 3 is a front plan view of a conventional antenna of the prior art.

FIG. 2 shows an alternative preferred embodiment of the loop-slot antenna. Depending on the interior structure of the mobile phone, the structure of the loop-slot antenna is changed to be adapted to the mobile phone.

As shown in FIG. 2, the longitudinal slot section 24' of the first slot 20' extends upward from the left end of the transverse slot section 22' to a predetermined distance, and then meanders like a recumbent V. The longitudinal branch 44' of the first strip 40' extends from the left end of the transverse branch 42' corresponding to the longitudinal slot section 24'. The feed point 45' is disposed on the top portion of the longitudinal branch 44'. The right portion of the patch element 50' extends rightward to form an arced tail. The second slot 30' is defined in the arced tail and is arc-shaped. The second slot 30' divides the arced tail to form the second strip 60' that is also arc-shaped corresponding to the second slot 30'. The grounding point 65' is disposed on the left end of the second strip 60'.

As described above, the loop-slot antenna is shown with two very different types of a slot antenna and a planar loop antenna, yet the two antenna elements radiate at multi-band frequency. The patch element 50 resonates at lower frequency with the electrical length of a half wavelength and achieves an effective performance. The loop-slot antenna provides at a low cost with simple structure and is implemented in a convenient manner by integral forming technology for installation in the internal of the mobile phone.

While specific components and functions of the multi-band loop-slot antenna are described above, fewer or additional functions could be employed by one skilled in the art within the broad scope of the present invention. The invention should be limited by the appended claims.

What is claimed is:

1. A loop-slot antenna defined by a conductive plate comprising:

a first slot defined in the conductive plate, the first slot including a transverse slot section extending along the lower edge of the conductive plate and a longitudinal slot section extending upward along the left edge of the conductive plate and opening to the upper edge of the conductive plate, the first slot being operable at a first frequency;

a first strip including a transverse branch located below the transverse slot section and a longitudinal branch beside the longitudinal slot section, the longitudinal branch having a feed point at the top end thereof;

a second slot being defined in the conductive plate and extending along the upper edge of the conductive plate, the left end of the second slot opening to the upper edge of the conductive plate;

a second strip element being located above the second slot and having a free end, a grounding point being disposed on the free end of the second strip; and a patch element located between the first slot and the second slot, the patch element being operable at a second frequency.

2. The loop-slot antenna as claimed in claim 1, wherein said first slot and said first strip are L-shaped respectively.

3. The loop-slot antenna as claimed in claim 1, wherein said first slot has an electrical length of about a quarter wavelength of the first frequency.

4. The loop-slot antenna as claimed in claim 1, wherein said patch element has an electrical length of about half wavelength of the second frequency from the feed point through the patch element to the grounding point.

5. A loop-slot antenna defined by a conductive plate, comprising:

an open-end slot antenna defined in the conductive plate, the open-end slot antenna including a transverse slot section defined in the lower portion of the conductive plate and a longitudinal slot section extending upward from the transverse slot section with a top end thereof opened, the open-end slot antenna being operable at a first frequency;

an elongate slot being defined in the conductive plate at a position far from the transverse slot section, the elongate slot having a closed end and an open end opening upward;

a loop antenna having a patch element located between the open-end slot antenna and the elongate slot, the loop antenna being operable at a second frequency;

a first strip attached to the lower portion of the conductive plate, the first strip having a transverse branch extending along the transverse slot section and a longitudinal branch extending along the longitudinal slot section, the longitudinal branch having a feed point at the top end thereof; and a second strip attached to the conductive plate at a position adjacent to the closed end of the elongate slot, the second strip extending along the elongate slot and having a free end, a grounding point being disposed on the free end.

6. The loop-slot antenna as claimed in claim 5, wherein the right portion of said patch element extends rightward to form a tail, the elongate slot is defined in the tail.

7. The loop-slot antenna as claimed in claim 6, wherein the elongate slot and the second strip are arc-shaped respectively.

8. The loop-slot antenna as claimed in claim 5, wherein the first strip is L-shaped.

9. The loop-slot antenna as claimed in claim 5, wherein the total length of the transverse slot section and the longitudinal slot section is about a quarter wavelength of the first frequency.

10. The loop-slot antenna as claimed in claim 5, wherein said patch element has an electrical length of about half wavelength of a second frequency from the feed point through the patch element to the grounding point.

* * * * *